US012084825B2

(12) United States Patent
Barton et al.

(10) Patent No.: US 12,084,825 B2
(45) Date of Patent: Sep. 10, 2024

(54) METHODS TO PREVENT SOIL EROSION AND STABILIZE SEAWALLS

(71) Applicant: Alchemy-Spetec LLC, Tucker, GA (US)

(72) Inventors: Stephen Christopher Barton, Atlanta, GA (US); Colt Allen Hullander, Bronson, FL (US); Kenneth Ray Braunlich, II, Cape Coral, FL (US)

(73) Assignee: Alchatek, LLC, Tucker, GA (US)

( * ) Notice: Subject to any disclaimer, the term of this patent is extended or adjusted under 35 U.S.C. 154(b) by 0 days.

(21) Appl. No.: 18/061,295

(22) Filed: Dec. 2, 2022

(65) Prior Publication Data

US 2024/0183119 A1 Jun. 6, 2024

(51) Int. Cl.
*E02B 3/10* (2006.01)

(52) U.S. Cl.
CPC ..... *E02B 3/10* (2013.01)

(58) Field of Classification Search
CPC ..... E02D 3/12; E02D 31/02; E02D 37/00; E02B 3/10
See application file for complete search history.

(56) References Cited

U.S. PATENT DOCUMENTS 2,627,169 A * 2/1953 Poulter ..... E02D 35/00 405/267
3,623,330 A * 11/1971 Nakade et al. ..... C09K 17/48 521/110
3,747,353 A * 7/1973 Monahan ..... E02D 27/46 52/169.1
4,181,450 A 1/1980 Rasen et al.
4,567,708 A 2/1986 Haekkinen
(Continued)

FOREIGN PATENT DOCUMENTS

AU 2015258319 B2 4/2021
CN 2397136 Y 9/2000
(Continued)

OTHER PUBLICATIONS

Powell, Andy; "Stop Erosion Through Your Seawall with Polyurethane"); Jul. 2018; All (Year: 2018).*
(Continued)

*Primary Examiner* — Benjamin F Fiorello
(74) *Attorney, Agent, or Firm* — Meunier Carlin & Curfman LLC

(57) ABSTRACT

The present disclosure relates to methods of stabilizing a seawall and reducing erosion around a seawall. Disclosed herein are methods of reducing erosion around a seawall, comprising injecting an amount of a sealing material to an injection depth at each of a plurality of spaced locations along a landward side of a new seawall. Also disclosed herein are methods for forming a chemical footer for a seawall comprising injecting a polymeric material to an injection depth from 1 foot to 3 feet below the mudline at each of a plurality of spaced locations along a landward side of a seawall. Additionally described herein are methods for reinforcing a seawall, comprising injecting a polymeric material to an injection depth at a plurality of spaced locations along the landward side of the seawall, wherein the injection depth is substantially at the vertical midpoint between the mudline and the top of the seawall.

26 Claims, 6 Drawing Sheets

(56) References Cited

U.S. PATENT DOCUMENTS

| | | | | |
|---|---|---|---|---|
| 5,158,395 | A | 10/1992 | Holmberg | |
| 5,224,794 | A | 7/1993 | Atkinson et al. | |
| 5,253,957 | A * | 10/1993 | Fujikawa | E04G 23/02 52/742.16 |
| 5,549,418 | A * | 8/1996 | Devine | E02D 17/18 52/309.4 |
| 5,911,545 | A * | 6/1999 | Heitkamp | E02D 17/20 52/742.16 |
| 6,634,831 | B2 * | 10/2003 | Canteri | E02D 3/12 52/742.13 |
| 7,517,177 | B2 * | 4/2009 | Erdemgil | E02D 27/34 405/266 |
| 8,596,924 | B2 | 12/2013 | Shimada et al. | |
| 9,644,334 | B2 | 5/2017 | O'Neill et al. | |
| 9,822,497 | B2 * | 11/2017 | Doan | E01C 11/005 |
| 10,124,281 | B2 | 11/2018 | Heilman et al. | |
| 10,138,641 | B2 * | 11/2018 | Tabatabai | E04G 23/0229 |
| 10,487,473 | B2 * | 11/2019 | Asplin | E02D 27/48 |
| 10,760,236 | B2 * | 9/2020 | Eddie | G01N 33/24 |
| 2011/0103897 | A1 * | 5/2011 | Ruel | E02D 5/76 405/262 |
| 2017/0081824 | A1 * | 3/2017 | Kondas | E02D 31/02 |
| 2018/0028950 | A1 * | 2/2018 | Heilman | B01D 29/15 |
| 2019/0211525 | A1 * | 7/2019 | Heilman | E02D 31/10 |
| 2021/0285174 | A1 * | 9/2021 | Babcock | E02D 5/03 |
| 2021/0285179 | A1 * | 9/2021 | Wang | E02D 3/12 |

FOREIGN PATENT DOCUMENTS

| | | |
|---|---|---|
| GB | 2571115 B | 8/2021 |
| JP | 4972661 B2 | 7/2012 |

OTHER PUBLICATIONS

Alchemy Spetec; "AP Fill 700"; Jul. 2018; All (Year: 2018).*
Bosboom, Judith et al.; "Seawalls"; Dec. 19, 2021; All (Year: 2021).*
Prime Resins; "Seawall Repair with Chemical Grouts"; Aug. 12, 2022; All (Year: 2022).*
Coastal Foundation Solutions; Pelican Isle Yacht Club Seawall Repair; Dec. 2, 2021; All (Year: 2021).*
Alchatek, Polyurethane Seawall Repair Explained; "https://www.youtube.com/watch?v=8_Y_UnrHEDQ"; Feb. 14, 2020 (Year: 2020).*
Alchemy Spetec; "AP Fill 720"; All; 2020 (Year: 2020).*
Yasser Krayem; Seawall Repair by Slab Fix; "https://www.youtube.com/watch?v=Pja_GXyeUyA"; Feb. 2, 2021 (Year: 2021).*
Prime Resins; Seawall Stabilization with Prime Flex 910; https://www.youtube.com/watch?v=RwK5vKCZKzE; Apr. 19, 2011 (Year: 2011).*
US Army Corps of Engineers, 1995. Design of Coastal Revetments, Seawalls, and Bulkheads.
Pinellas Gulf Beaches Coastal Construction Code § 3109 (2004).
City of Marco Island Ordinance No. 06-18 (2006).

* cited by examiner

METHODS TO PREVENT SOIL EROSION AND STABILIZE SEAWALLS

BACKGROUND

Flooding and soil erosion have created structural issues for properties located near a body of water. To combat these effects, structures such as seawalls have historically been erected to provide a defense for coastal properties against damage caused by the abutting water. However, the ground these seawalls sit on often continues to erode, leading to premature structural damages to the seawall and requiring expensive repairs or a total replacement of the seawall. Thus, methods of permanently stabilizing seawalls are needed to ensure coastal residences are adequately protected from the water damage.

SUMMARY

The present disclosure relates to methods of stabilizing seawalls and reducing erosion around seawalls. Disclosed herein are methods of reducing erosion around a seawall, comprising injecting an amount of a sealing material to an injection depth at each of a plurality of spaced locations along a landward side of a new seawall. Also disclosed herein are methods for forming a chemical footer for a seawall comprising injecting an amount of a polymeric material to an injection depth at each of a plurality of spaced locations along a landward side of a seawall, wherein the injection depth is from 1 foot to 3 feet below the mudline at the seawall. Additionally described herein are methods for reinforcing a seawall, comprising injecting an amount of a polymeric material to an injection depth at a plurality of spaced locations along the landward side of the seawall, wherein the injection depth is substantially at the vertical midpoint between the mudline and the top of the seawall.

The details of one or more embodiments of the invention are set forth in the accompanying drawings and the description below. Other features, objects, and advantages of the invention will be apparent from the description and drawings, and from the claims.

BRIEF DESCRIPTION OF THE FIGURES

The accompanying figures, which are incorporated in and constitute a part of this specification, illustrate several aspects of the disclosure, and together with the description, serve to explain the principles of the disclosure.

DETAILED DESCRIPTION

Figure 1:
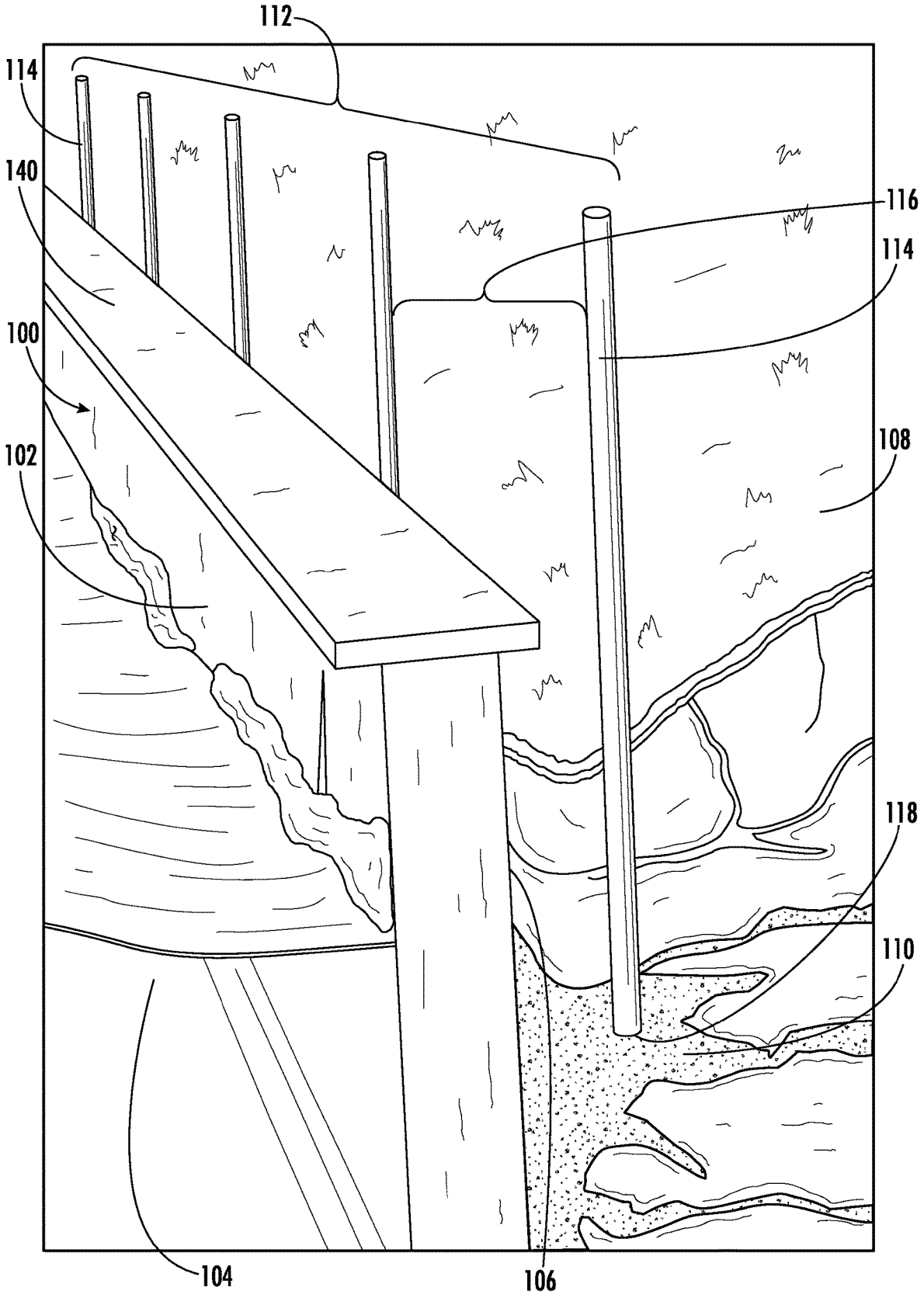
FIG. 1 depicts a perspective view of the insertion of injection rods along the landward side of a seawall structure.

The methods described herein may be understood more readily by reference to the following detailed description of specific aspects of the disclosed subject matter.

Before the present methods are disclosed and described, it is to be understood that the aspects described below are not limited to specific methods, as such may, of course, vary. It is also to be understood that the terminology used herein is for the purpose of describing particular aspects only and is not intended to be limiting.

Definitions

In this specification and in the claims that follow, reference will be made to a number of terms, which shall be defined to have the following meanings:

Throughout the description and claims of this specification the word "comprise" and other forms of the word, such as "comprising" and "comprises," means including but not limited to, and is not intended to exclude, for example, other additives, components, integers, or steps.

As used in the description and the appended claims, the singular forms "a," "an," and "the" include plural referents unless the context clearly dictates otherwise. Thus, for example, reference to "a composition" includes mixtures of two or more such compositions, reference to "the compound" includes mixtures of two or more such compounds, reference to "an agent" includes mixture of two or more such agents, and the like.

Values can be expressed herein as an "average" value. "Average" generally refers to the statistical mean value.

As used herein, "plurality" means more than one. For example, a plurality can refer to 2 or more, such as 3 or more, 4 or more, 5 or more, 10 or more, or 100 or more.

By "substantially" is meant within 10%, e.g., within 5%, 4%, 3%, 2%, or 1%.

"Exemplary" means "an example of" and is not intended to convey an indication of a preferred or ideal embodiment. "Such as" is not used in a restrictive sense, but for explanatory purposes.

It is understood that throughout this specification the identifiers "first" and "second" are used solely to aid the reader in distinguishing the various components, features, or steps of the disclosed subject matter. The identifiers "first" and "second" are not intended to imply any particular order, amount, preference, or importance to the components or steps modified by these terms.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

Methods for Stabilizing and Reducing Erosion of New Seawalls

FIG. 1 illustrates a seawall 100. A "seawall" generally refers to a structure that provides erosion protection and/or flooding protection where water meets land. The seawall 100 can be a structure erected adjacent to any body of water, such as a harbor, river, lake, sea, or ocean to prevent erosion and/or flooding protection. The seawall has a seaward side 102 that is adjacent to and faces the water 104 and a landward side 106 that opposes the seaward side and is adjacent to and faces the land 108. The term "seaward" can be used interchangeably with "waterward" and can be used even if the body of water is freshwater such as a levee along a riverbank. As better shown by FIG. 5, the seawall 100 includes multiple panels 107 along its length having seams 109 therebetween that include a sealing material to prevent water and other materials from passing through them.

A sealing material (for example, sealing material 110) can be injected into the landward side 106 such as through the use of an injection system 112. An exemplary injection system 112 is the PolyShark® system manufactured by Alchemy Spetec®. An injection system of this type can include a series of injection rods 114 and a pump that can generate a sufficiently large enough pressure to ensure that the sealing material 110 disperses throughout the soil, thereby lending greater resilience to erosion. Injection pressures will vary depending on parameters of the system such as the type of material and ground permeability; however, suitable injection pressures are generally 4,000 psi or less, such as 2,000 psi or less, 1,000 psi or less, 500 psi or less, 400 psi or less, 300 psi or less, 200 psi or less, 100 psi or less, or 50 psi or less. The injection can include drilling holes on the landward side 106 of the seawall 100 and inserting the injection rods 114. The injection system 112 may further include one or more injection hoses coupled with the pump to direct the sealing material to each of the injection rods 114. As shown in FIG. 1, the injection system 112 can include injection rods 114 provided at a plurality of spaced locations along the landward side 106. The plurality of spaced locations are separated by an average distance 116 of from 0.5 to 4 feet, such as from 1 to 3 feet, from 1.5 to 2.5 feet, or about 2 feet. Spacing at this distance ensures the sealing material laterally permeates the soil to create a greater degree of soil stabilization. The injection rods 114 can be inserted into the landward side 106 of the seawall 100 at an injection depth 118 below the mudline 120 thus allows the sealing material 110 to fill voids in the soil below the mudline. The term "mudline" refers to the interface between the earth's crust and the overlying water on the seaward side.

In some aspects, the injection depth 118 at each of the plurality of spaced locations is at or below the mudline 120, such as at least 1 foot below the mudline, at least 1.5 feet below the mudline, or at least 2 feet below the mudline. The injection depth 118 may be at a depth of from 1 foot below the mudline 120 to 5 feet below the mudline, such as from 1 foot to 4 feet below the mudline, from 2 feet to 4 feet below the mudline, from 2 feet to 5 feet below the mudline, from 1 feet to 3 feet below the mudline, from 2 feet to 3 feet below the mudline, from 3 feet to 5 feet below the mudline, from 3 feet to 4 feet below the mudline, or about 3 feet below the mudline. The sealing material 110 can be injected at each of the plurality of spaced locations in an amount of from 0.5 to 2 gallons per vertical foot, such as from 0.5 to 1.5 gallons per vertical foot, or about 1 gallon per vertical foot. In some embodiments, the amount of sealing material 110 applied is at least 1 gallon per vertical foot at each of the plurality of spaced locations. This amount ensures that a sufficient amount of the sealing material 110 is introduced to the soil to effectively stabilize the seawall 100.

The sealing material 110 can be selected of a material that can readily fill the voids on the landward side 106 of the seawall 100 and that is sufficiently durable to not readily be worn away by the elements. For example, the sealing material 110 can include a polymeric material, a microfine cement, a sodium silicate, an acrylic resin, or mixtures thereof. The polymeric material can be an expandable polymeric material or a non-expandable polymeric material. In some embodiments, the sealing material includes an expandable polymeric material. Expandable polymeric materials are materials configured to expand volumetrically when activated by a target compound. For example, a polymeric material suitable for use as a sealing material can be a water-activated polymeric material (where water is the target compound). In some embodiments, the polymeric material comprises a polyurethane, such as a water-activated polyurethane. The water-activated polyurethane can be provided as a single component. In various embodiments, the polyurethane expands to form closed-cell polyurethane.

The term "polyurethane," as used herein refers to a polymer comprising two or more urethane (or carbamate) linkages. The polyurethane can include other types of linkages, however. For example, in some instances, the polyurethane can contain urea linkages. In some other instances, a urea or urethane group can further react to form further groups, including, but not limited to, an allophanate group, a biuret group, or a cyclic isocyanurate group. In some embodiments, at least 70%, or at least 80%, or at least 90%, or at least 95% of the linkages in the polyurethane are urethane linkages. The polyurethane can be a polyurethane block copolymer, which refers to a block copolymer, where one or more of the blocks are primarily urethane linkages and other blocks contain fewer urethane linkages.

The polymerization of the polymeric material can occur with or without a catalyst and/or crosslinking agent. The addition of a catalyst and/or a crosslinking agent can speed up the polymerization reaction and decrease the set time. Examples of some suitable catalysts include tertiary amines such as triethylamine, N-methylmorpholine, N-ethylmorpholine, N-cocomorpholine, dimethyl-benzyl amine, triethylene diamine, N,N'-dimethyl-2-methylpiperazine, pentamethyl-diethylene triamine, or stannous chloride, organo-tin compounds including dibutyl tin dilaurate, dibutyl tin oxide, or stannous octate. In some embodiments, AP Cat 106 and/or AP Cat 107 available from Alchemy Spetec® can be used. In some embodiments, the polymerization can occur without the addition of a catalytic compound.

If an expandable polymeric material is used, the expandable polymeric material may further be defined based on its expansion ratio, which refers to a ratio of a bulk density of the polymeric material at a state before it has been activated to expand to a bulk density of the expandable polymeric material at a state after foaming. In various embodiments, the expansion ratio of the expandable polymeric material can be from 5 to 100, such as from 10 to 100, from 20 to 80, or from 30 to 60.

Suitable polyurethanes for use as the sealing material include AP Fill 700, SW-RP1, and SW-RP6, which are single component, water-activated, hydrophobic, low viscosity, closed cell polyurethane injection resins commercially available from Alchemy Spetec®. In some embodiments, the polymeric material has a fast set time such as from 5 to 60 seconds, or from 20 to 60 seconds. The polymeric material is also provided at a suitable viscosity such as from 5 to 350 cP at 77° F., such as from 50 cP to 250 cP at 77° F., from 100 to 250 cP at 77° F., from 150 to 250 cP at 77° F., or from 200 to 250 cP at 77° F.

The disclosed method can be used to reinforce new seawalls 100 prior to damage caused by erosion of the soil. By proactively injecting a sealing material 110 to an injection depth 118 before substantial erosion has occurred, the longevity of the seawall 100 can be preserved. The term "new seawall" generally refers to a seawall or a portion of a seawall that has not experienced significant structural damage as a result of soil erosion. In some embodiments, a seawall is classified as a "new seawall" based on the duration of time that has elapsed since the completion date for the construction of the seawall. The terms "completion date" and "construction date" are used interchangeably and generally refer to the date upon which a discrete section of the seawall construction is substantially completed. Because seawalls often span large distances and may be constructed in segments, the construction date can refer to the completion of a modular section of the seawall.

For example, a seawall 100 can be a new seawall if 12 months or less have elapsed since the construction date, such as 6 months or less, 3 months or less, 1 month or less, 2 weeks or less, 1 week or less, 3 days or less, 2 days or less, or 1 day or less from the construction date. Injecting a sealing material 110 within these times reduces the likelihood of later developed structural damage of the seawall structure resulting from erosion of the bedding soil.

Figure 2:
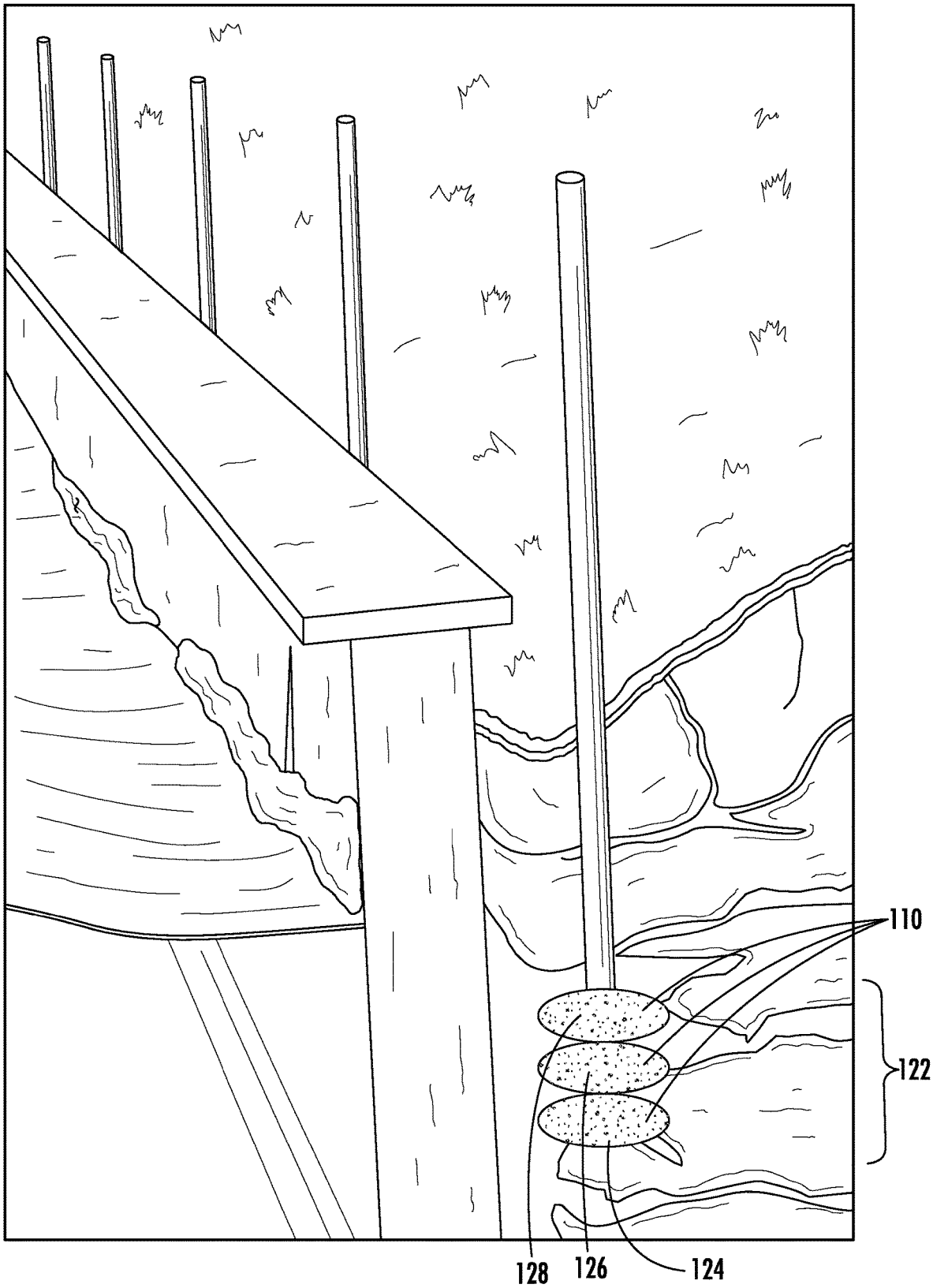
FIG. 2 depicts an upward-staging injection technique to dispose a polymeric material along a landward side of a seawall structure.

As shown in FIG. 2, the sealing material 110 can be introduced in an upwardly-staged pattern 122. For example, the upwardly-staged pattern 122 can include two or more injections of decreasing size as the injection rods 114 are moved upward (e.g., injections 124, 126 and 128). As shown in more detail in FIG. 3, this upward staging can result in the sealing material 110 expanding to form a substantially conical shape. The substantially conical shapes together form an undulating pattern 130 as shown in FIG. 3.

Figure 3:
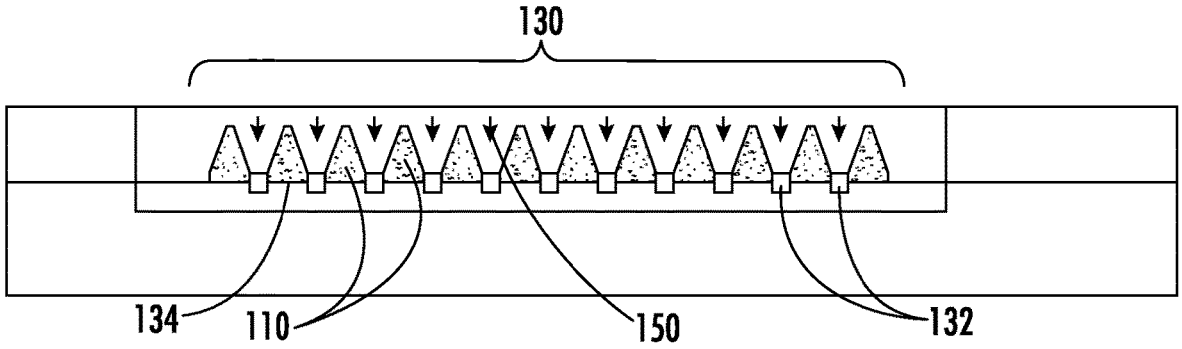
FIG. 3 represents a projection view from the top end of the seawall showing the flow of water through a plurality of dewatering channels.
Figure 4:
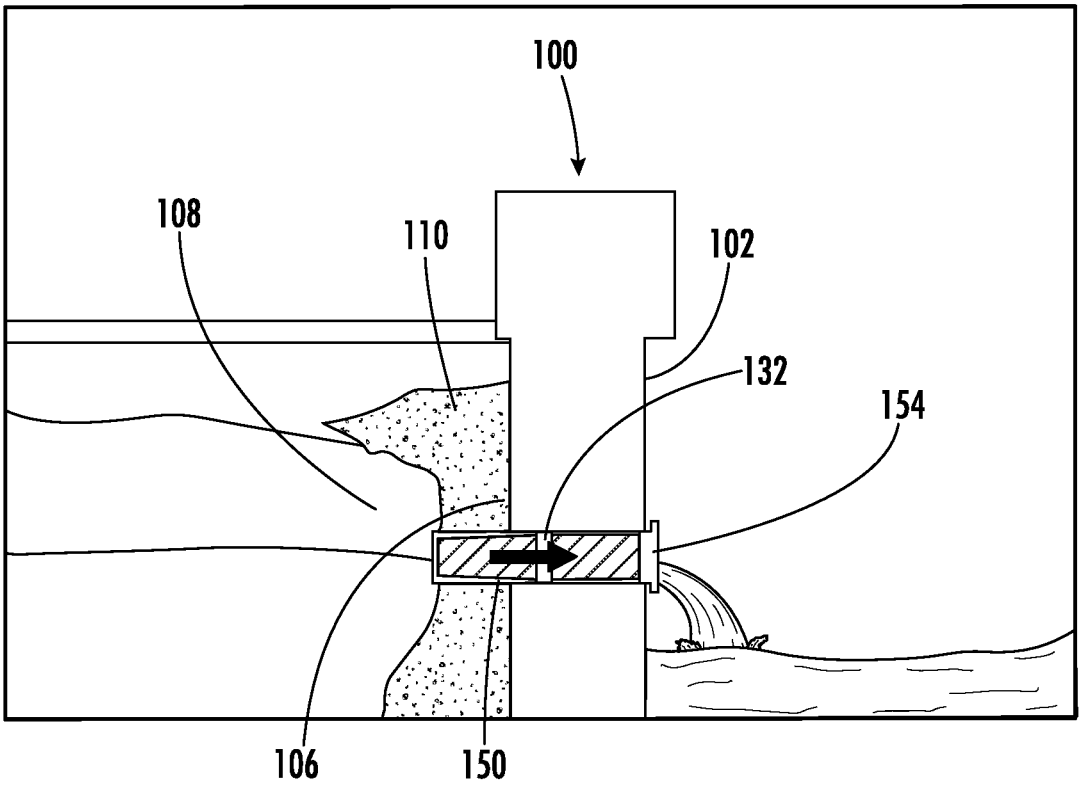
FIG. 4 depicts a side view of the seawall representing the flow of water through a panel filter.

As shown in FIGS. 3 and 4, the seawall 100 can include one or more dewatering channels 150 that can be defined at least in part by the undulating pattern 130 and that can extend through the seawall 100. These dewatering channels 150 generally operate to relieve hydrostatic pressure from the liquid retained on the landward side 106 of the seawall by creating paths for fluid drainage. As illustrated in FIG. 4, the dewatering channel 150 extends through the sealing material 110 from the landward side 106 of the seawall 100 to the waterward side 102 of the seawall, such that the land 108 on the landward side is in fluid communication with an outlet 154 of the dewatering channel adjacent the waterward side of the seawall. The dewatering channel 150 can further include a filter, such as a panel filter 132 disposed within or adjacent to the dewatering channel 150 to reduce the amount of soil that passes through the dewatering channel 150. Various types of panel filters, such as the one described in U.S. Pat. No. 10,124,281, are suitable for use in the present methods.

Various aspects additionally include positioning one or more dewatering channels 150 prior to or concurrent with the injection of the sealing material each of the plurality of spaced locations. However, in other implementations, the one or more dewatering channels 150 are positioned subsequent to an injection of the sealing material 110. The one or more dewatering channels 150 can be positioned by, for example, drilling or boring holes through the seawall structure 100 at the plurality of spaced locations along the length of the seawall 100. Although the dewatering channel 150 in FIG. 4 is angled substantially normal relative to the seaward side 102 of the seawall 100, the one or more dewatering channels 150 can also be positioned at an oblique angle depending on the specifications of the system. In various aspects, each of the plurality of spaced locations can be positioned substantially at the horizontal midpoint 134 between adjacent outlets 154 of the dewatering channels 150 in the seawall 100, as shown, for example, in FIG. 3. By positioning the plurality of spaced locations substantially at the horizontal midpoint 134 between adjacent outlets 154, the undulating pattern 130 of the sealing material 110 can advantageously funnel fluid retained on the landward side through the dewatering channels 150.

A filter fabric, such as described in U.S. Pat. No. 4,181,450, can be used in the construction of seawall 100 to reduce the effects of soil erosion. The methods of stabilizing the seawall 100 described herein can eliminate the need for a filter fabric by limiting erosion on the landward side 106 of a new seawall, thus reducing the cost of the seawall installation. Thus, the seawall 100 can be constructed without using a filter fabric. Filter fabrics can also be used in conjunction with the methods of stabilizing the seawall 100 described herein. Advantageously, the sealing material 110 can be used to fix the filter fabric in place and can work with the filter fabric to reduce erosion. The combination of the methods described herein and the filter fabric can create permanent dewatering channels while maintaining structural resilience as compared to the use of filter fabrics alone.

Method of Forming a Chemical Footer for a Seawall

Figure 5:
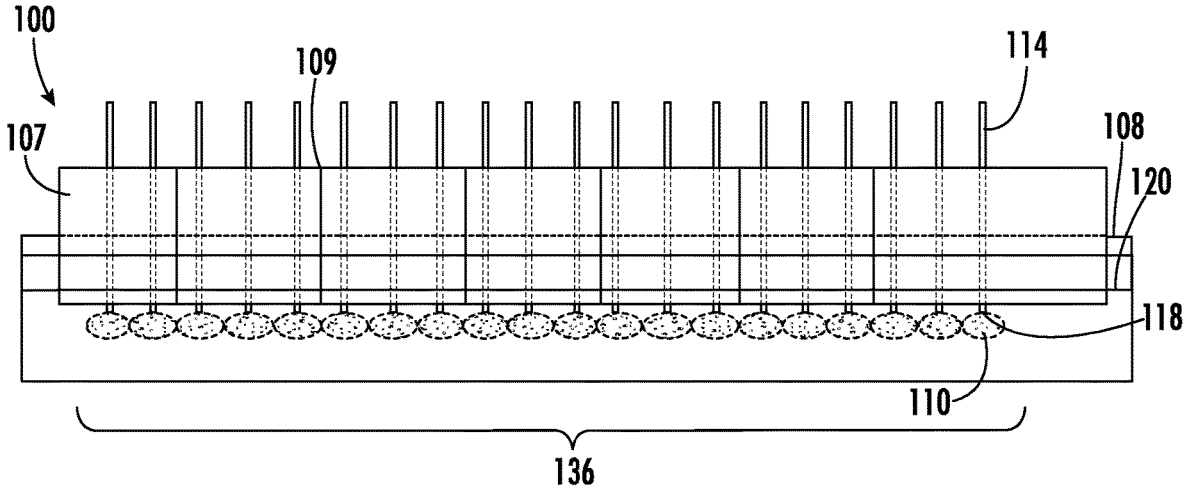
FIG. 5 depicts a seaward-side view of the seawall representing a chemical footer.

The sealing material 110 and specifically the polymeric material can also be used to form a chemical footer for a seawall 100 and can be used in conjunction with the other methods discussed herein. As shown in FIG. 5, the method for forming the chemical footer includes injecting an amount of a sealing material 110, such as those described above, to an injection depth 118 at each of a plurality of spaced locations to form a substantially continuous application of the sealing material 110 along a length 136 of the landward side 106 of a seawall 100. In some embodiments, the injection depth is from 1 foot to 3 feet below the mudline 120, from 1.5 feet to 2.5 feet below the mudline, or about 2 feet below the mudline. An injection of the sealing material 110 at or around this depth along a length 136 of the seawall 100 provides a solidified reinforced structural base for the seawall to prevent collapse.

The sealing material 110 can be injected through the use of an injection system 112 as discussed above that includes a plurality of injection rods 114 at a plurality of spaced locations separated by an average distance 116 of from 0.5 to 4 feet, such as from 1 to 3 feet, from 1.5 to 2.5 feet, or about 2 feet. In some aspects, the sealing material 110 is injected in an amount of from 0.5 to 3 gallons, for example, from 1 to 2 gallons, or about 1 gallon per horizontal foot of seawall 100.

As discussed above, the sealing material 110 is provided in a substantially continuous application along a length 136 of the seawall 100. The substantially continuous application means that there are minimal vertical gaps where there is no sealing material 110 along the length 136. For example, at least 90% or at least 95% of the length 136 includes sealing material 110. In some embodiments, the substantially continuous application of the sealing material spans a length 136 of at least 6 feet of the seawall 100. For example, the substantially continuous application of the sealing material 110 can span substantially the full length 136 of the seawall 100 as shown in FIG. 5. This substantially continuous application of the sealing material 110 provides increased structural stability of the seawall 100 and reduces degradation of the seawall along the chemical footer.

Method for Reinforcing a Seawall Structure

Figure 6:
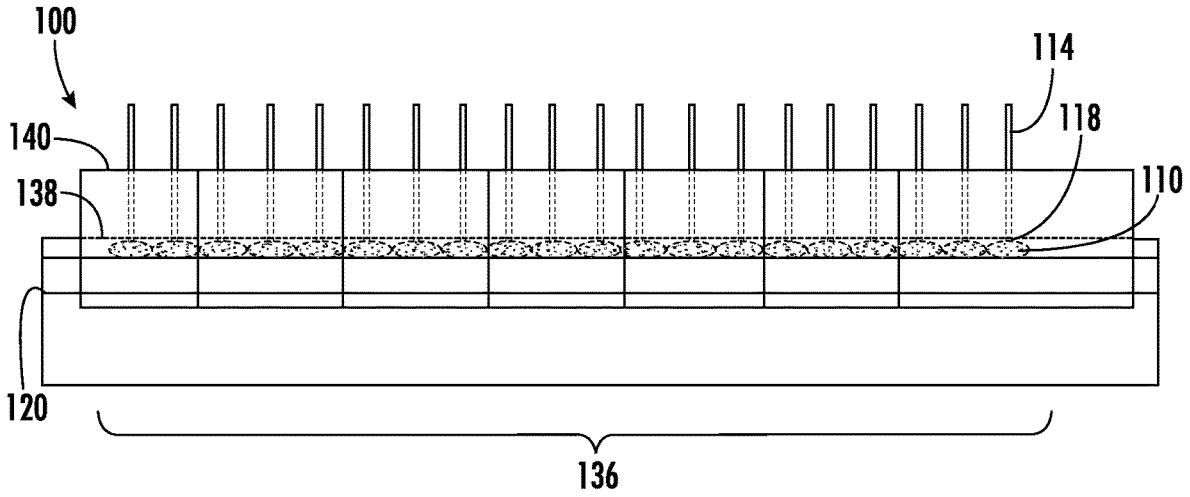
FIG. 6 show a seaward-side view of the seawall representing a method of reinforcing the seawall.

The sealing material 110 and specifically the polymeric material can also be used to form a chemical whaler along a portion of the seawall 100 and can be used in conjunction with the other methods discussed herein. As shown in FIG. 6, an amount of a sealing material 110 to an injection depth 118 at a plurality of spaced locations along the landward side 106 of the seawall 100, wherein the injection depth is substantially at the vertical midpoint 138 between the mudline 120 and the top 140 of the seawall. In various implementations, the injection depth 118 is within 2 vertical feet, within 1 vertical foot, or within 0.5 vertical feet of the vertical midpoint 138 between the mudline 120 and the top 140 of the seawall 100. Injection of the sealing material 110 at this location near the vertical midpoint 138 provides a reinforcing chemical whaler resistant to distortion or deformation of the seawall 100.

The sealing material 110 can be injected through the use of an injection system 112 as discussed above that includes a plurality of injection rods 114 at a plurality of spaced locations separated by an average distance 116 of from 0.5 to 4 feet, such as from 1 to 3 feet, from 1.5 to 2.5 feet, or about 2 feet. In some aspects, the sealing material 110 is injected in an amount of from 1 to 2 gallons per horizontal foot of seawall 100.

The sealing material 110 can be provided in a substantially continuous application along a length 136 of the seawall 100. The substantially continuous application means that there are minimal vertical gaps where there is no sealing material 110 along the length 136. For example, at least 90% or at least 95% of the length 136 includes sealing material 110. In some embodiments, the substantially continuous application of the sealing material spans a length 136 of at least 6 feet of the seawall 100. For example, the substantially continuous application of the sealing material 110 can span substantially the full length 136 of the seawall 100 as shown in FIG. 6. This substantially continuous application of the sealing material 110 reduces instances of structural weaknesses at particular points along the seawall 100.

The compositions and methods of the appended claims are not limited in scope by the specific compositions and methods described herein, which are intended as illustrations of a few aspects of the claims and any compositions and methods that are functionally equivalent are within the scope of this disclosure. Various modifications of the compositions and methods in addition to those shown and described herein are intended to fall within the scope of the appended claims. Further, while only certain representative compositions and methods, and aspects of these compositions and methods are specifically described, other compositions and methods and combinations of various features of the compositions and methods are intended to fall within the scope of the appended claims, even if not specifically recited. Thus a combination of steps, elements, components, or constituents can be explicitly mentioned herein; however, all other combinations of steps, elements, components, and constituents are included, even though not explicitly stated.

What is claimed is:

1. A method of reducing erosion around a new seawall, the method comprising:

injecting an amount of a sealing material to an injection depth at each of a plurality of spaced locations along a landward side of the new seawall to form an undulating pattern, wherein the new seawall is a seawall that has been constructed within 12 months and before substantial soil erosion has occurred; and thereafter drilling or boring one or more dewatering channels that extend through the new seawall and at least a portion of the sealing material, wherein the one or more dewatering channels create paths for the flow of water such that the sealing material directs water from the landward side of the new seawall to an outlet adjacent the waterward side of the new seawall.

2. The method of claim 1, wherein the sealing material includes a polymeric material, microfine cement, sodium silicate, an acrylic resin, or mixtures thereof.

3. The method of claim 1, wherein the sealing material includes a polymeric material and wherein the polymeric material comprises a polyurethane.

4. The method of claim 3, wherein the polyurethane comprises a single-component closed-cell polyurethane.

5. The method of claim 1, wherein the sealing material is an expandable polymeric material.

6. The method of claim 1, wherein the injecting step is performed within 1 week from the construction date of the new seawall.

7. The method of claim 1, wherein positioning the one or more dewatering channels comprises positioning at least two dewatering channels, and wherein the injection of the sealing material occurs substantially at the horizontal midpoint between adjacent outlets in the new seawall structure.

8. The method of claim 1, wherein the plurality of spaced locations are separated by an average distance of from 0.5 to 4 feet.

9. The method of claim 1, wherein the injection depth is at or below the mudline.

10. The method of claim 1, wherein the sealing material is applied in an amount of at least one gallon per vertical foot at each of the plurality of spaced locations.

11. A method of forming a chemical footer for a new seawall comprising:

injecting an amount of a polymeric material to an injection depth at each of a plurality of spaced locations along a length of a landward side of the new seawall constructed without a filter fabric, wherein the new seawall is a seawall that has been constructed within 12 months and before substantial soil erosion has occurred;

wherein the injection depth is from 1 foot to 3 feet below the mudline at the new seawall, and wherein the plurality of spaced locations are separated by a distance such that injections of the polymeric material at each of the plurality of spaced locations form a substantially continuous application of the polymeric material along a length of the new seawall.

12. The method of claim 11, wherein the amount of the polymeric material comprises from 0.5 to 3 gallons of the polymeric material per horizontal foot of new seawall.

13. The method of claim 11, wherein the plurality of spaced locations are separated by an average distance of from 0.5 to 4 feet.

14. The method of claim 11, wherein the polymeric material comprises a polyurethane.

15. The method of claim 14, wherein the polyurethane comprises a single-component polyurethane.

16. The method of claim 11, wherein the polymeric material comprises an expandable polymeric material.

17. The method of claim 11, wherein the substantially continuous application of the polymeric material is at a length of at least 6 feet of the new seawall.

18. The method of claim 11, wherein the substantially continuous application of the polymeric material spans substantially the full length of the new seawall.

19. A method of reinforcing a new seawall with a chemical whaler, the method comprising:

injecting an amount of a polymeric material to an injection depth at a plurality of spaced locations along the landward side of the new seawall constructed without a filter fabric, wherein the new seawall is a seawall that has been constructed within 12 months and before substantial soil erosion has occurred;

wherein the injection depth is substantially at the vertical midpoint between the mudline and the top of the new seawall, and wherein the plurality of spaced locations are separated by a distance such that injections of the polymeric material at each of the plurality of spaced locations form a substantially continuous application of the polymeric material along the length of the new seawall.

20. The method of claim 19, wherein the polymeric material comprises a polyurethane.

21. The method of claim 20, wherein the polyurethane comprises a single-component closed-cell polyurethane.

22. The method of claim 19, wherein the polymeric material comprises an expandable polymeric material.

23. The method of claim 19, wherein the injection depth is within 2 vertical feet of the vertical midpoint between the mudline and the top of the new seawall.

24. The method of claim 19, wherein the amount of the polymeric material comprises from 1 to 2 gallons of the polymeric material per horizontal foot of new seawall.

25. The method of claim 19, wherein the substantially continuous application of the polymeric material is at a length of at least 6 feet of the new seawall.

26. The method of claim 19, wherein the substantially continuous application of the polymeric material spans substantially the full length of the new seawall.

* * * * *